United States Patent [19]

Harris

[11] Patent Number: 4,953,242

[45] Date of Patent: Sep. 4, 1990

[54] PADDED FLARE-BACK SOFA

[75] Inventor: Anne Harris, New York, N.Y.

[73] Assignee: Anne Harris, New York, N.Y.

[21] Appl. No.: 321,502

[22] Filed: Mar. 9, 1989

[51] Int. Cl.[5] ..... A47C 17/13; A47C 17/32

[52] U.S. Cl. ..... 5/18.1; 5/58

[58] Field of Search ..... 5/18 R, 18 B, 17, 58, 5/7, 12 R; D6/381

[56] References Cited

U.S. PATENT DOCUMENTS

| | | | |
|---|---|---|---|
| D. 182,655 | 4/1958 | Glass | D6/381 |
| D. 268,236 | 3/1983 | Stern | D6/381 |
| 520,635 | 5/1894 | Conant | 5/17 |
| 552,323 | 12/1985 | Langhorne | 5/14 |
| 1,001,625 | 8/1911 | Curtis | 5/14 |
| 1,139,442 | 5/1915 | Pessarra | 5/45 |
| 1,321,911 | 11/1919 | Hawkins | 5/12 |
| 1,360,478 | 11/1920 | Wajtukiewicz | 5/58 |
| 1,448,127 | 3/1923 | Konrad . | |
| 1,631,600 | 6/1927 | Morrison | 5/58 |
| 2,265,671 | 12/1941 | Quadri | 5/17 |
| 2,368,938 | 2/1945 | McKay | 5/58 |
| 2,392,688 | 1/1946 | Nagele | 5/58 |
| 2,412,628 | 12/1946 | McKeown et al. | 5/58 |
| 2,620,488 | 12/1952 | Woller | 5/14 |
| 2,691,175 | 10/1954 | Brahm et al. | 5/58 |
| 2,784,419 | 3/1957 | Cimon | 5/18 R |
| 2,810,919 | 10/1957 | Brown | 5/14 |
| 3,345,889 | 10/1967 | Gran | 5/12 |
| 3,733,624 | 5/1973 | Trabin | 5/58 |
| 4,297,752 | 11/1981 | Calvin et al. | 5/59 |

FOREIGN PATENT DOCUMENTS

| | | | |
|---|---|---|---|
| 471081 | 8/1937 | United Kingdom | 5/17 |

*Primary Examiner*—Alexander Grosz

[57] ABSTRACT

A convertible article of furniture presenting a sofa in one arrangement and a bed in the other. Both sides and the back of the furniture flare out horizontally to form a ledge useful for supporting objects. A retractable bottom member is slidably withdrawable from the sofa to projectably form, in conjuction with that sofa, a bed of increased width. An enclosed storage area is formed between the vertical back of the furniture and a back cushion member.

15 Claims, 5 Drawing Sheets

90
51
50
80
41
42
91
31
81
86
92
62
63
61
7
7
60
54
51

54
72
53
71
73
70
74
75

83
80
54
66
63
84
85
64
82

PADDED FLARE-BACK SOFA

TECHNICAL FIELD

The invention relates to an article of furniture which is convertible between a sitting unit and a sleeping unit.

BACKGROUND OF THE INVENTION

The mechanisms of convertible furniture for converting between a sitting unit (or seat) in the closed position and a sleeping unit (or bed) in the open position are usually complex devices. These devices include springs, bars, and hinges which may damage sheeting, etc. Further, these devices increase the weight of the furniture, making it more difficult both to move the furniture and to convert it. Conventional conversion procedures have been relatively difficult and complicated, especially for the elderly, children and the handicapped. Additionally, the devices often require substantial volume; this increased depth of the furniture is undesirable since space is often at a premium where the intent of a buyer of convertible furniture is to reduce the floor space required by using a single piece of furniture to function alternatively as two pieces. Designs for prior art sofabeds require about four inches between the mattress and the back of the couch in order for the conversion mechanism to operate. For example, a standard sofabed has a length of 89 inch.

Accessory tables are often required to support lighting in the immediate vicinity of the furniture. Additionally, the usual accoutrements of a bed, including the blankets, sheets, and pillows, are not easily and safely stored within the furniture when in the closed position.

SUMMARY OF THE INVENTION

In contrast to prior art convertible furniture, it has been found that apparatus or units, convertible between sitting and sleeping furniture, can be constructed such that said conversion process is relatively simple, the apparatus is more compact, a storage compartment for sheeting is available and convenient, and ledges are available for lighting and books.

A slidable bottom member is easily retracted from a main housing to enlarge the sitting surface of a sofa sufficiently to allow for sleeping on a bed. A mattress for this bed is provided by unfolding the double mattress of the sofa. Bedding for the bed is conveniently retrieved from a storage compartment existing only in the closed sofa configuration.

When configured as a sofa or a bed, the flared backs and sides provide a ledge useful for displaying or placing objects, such as books, lamps, and beverages.

A top platform extends this ledge as well as creating the storage compartment for the bedding when in the closed sofa configuration.

DETAILED DESCRIPTION OF THE DRAWINGS

Figure 1:
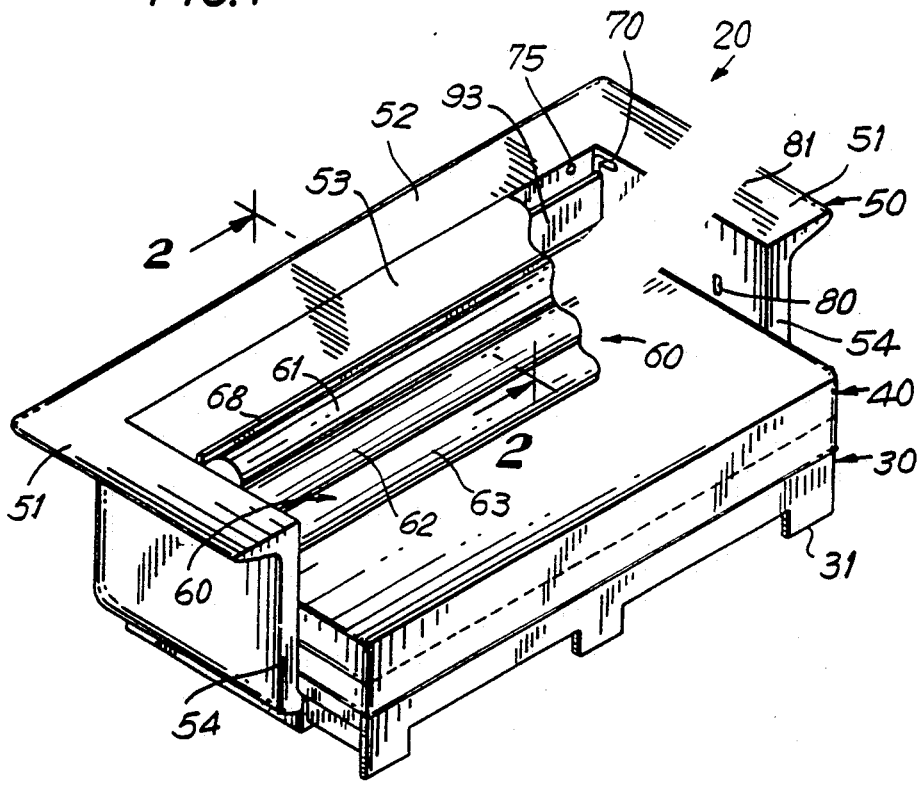
FIG. 1 is a perspective view of an article of furniture closed in a sitting position in accordance with the teachings of my invention.

Referring now to FIG. 1 of the drawing, a convertible article of furniture in a closed sitting position 20 is shown comprising a retractable bottom member 30, a double mattress 40 which cushions the seating area, a top housing 50 which partially encloses the bottom member 30, and a back cushion member 60. Bottom member 30 comprises a facing 31, and a first bedspring 32, which bedspring 32 is supported by two or more solid legs 33. Facing 31, attached to legs 33, serves to protect internal mechanisms of the furniture from dirt and damage, to prevent damage to clothing, etc. from the bedspring 32, and as a means to partially withdraw bottom member 30 from top housing 50. Also, facing 31 is aesthetically pleasing in color and texture, and carries out the design of the furniture First bedspring 32, as well as second bedspring 56, comprises steel bands or beechwood slats.

While the drawings show furniture convertible between a sofa and a full-size bed, the size of the furniture may, of course, be larger or smaller in order to more conveniently fit within any desired space. That is, a combination chair/single bed or a love seat/three-quarter bed might require only two legs while a sofa/full, sofa/queen, or sofa/king bed might require three legs. The number of legs 33 is determined by the length of the unit.

Figure 2:
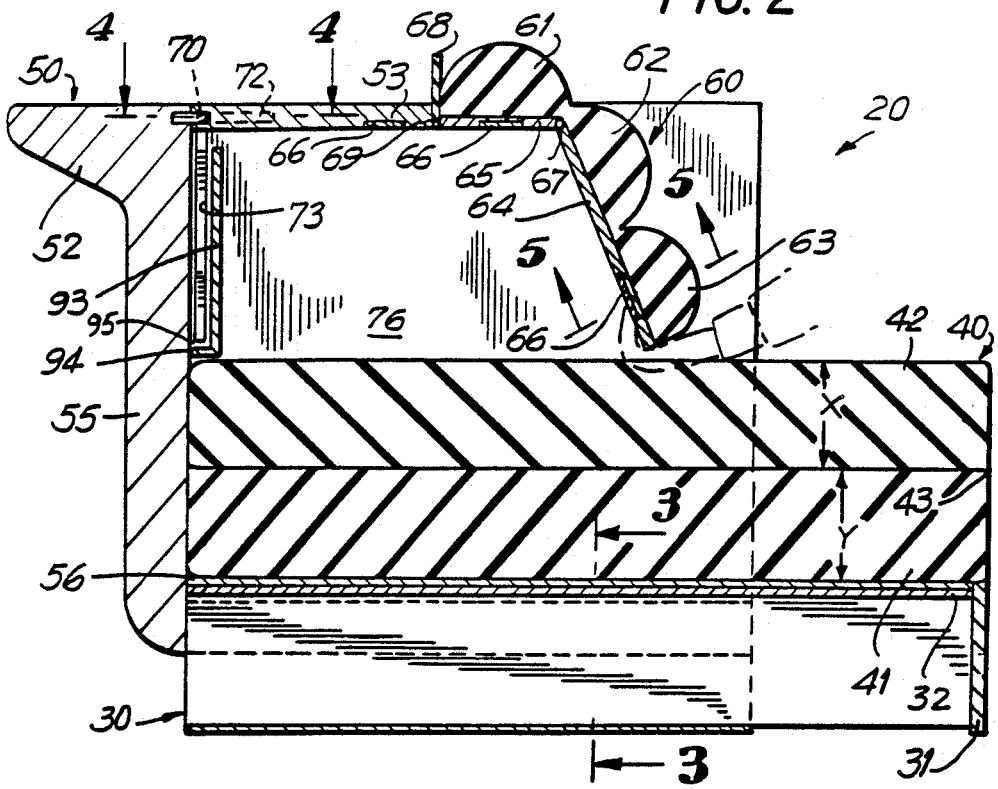
FIG. 2 is a view taken along lines 2—2 of FIG. 1 showing a side cross section of the article in the closed sitting position.

As shown in FIG. 2, bottom member 30 is slidably inserted within top housing 50 when the furniture is in the sitting position 20. Double mattress 40 consists of a lower mattress 41 and an upper mattress 42 When in the sitting position 20, a user of the furniture would sit upon upper mattress 41 a nd can lean against back cushion member 60. Upper and lower mattresses 41, 42 may be connected via material 43 such that when the mattresses 41, 42 are unfolded or opened to create a flat surface 91 of the convertible article of furniture in the sleeping position 90, the mattresses 41, 42 remain in close proximity and in proper alignment. The thickness X of upper mattress 42 should be slightly greater than the thickness Y of lower mattress 41 in order to compensate for the slightly lower resting position of upper mattress 42 when in the open position 90.

Top housing 50 comprises two horizontal side ledges or arm rests 51, a horizontal back ledge 52, a slidable top platform 53, two horizontal side walls 54, a horizontal back wall 55, a second bedspring 56, and a sleeve 57. Side ledges 51 and back ledge 52 are convenient for placing lamps, drinks, books, decorations, etc. These ledges 51, 52 obviate the need for the usual accessory tables, thereby saving both the cost of those tables and eliminating the floor space otherwise required for them. While they may be upholstered, these ledges 51, 52 should not be heavily cushioned but rather must remain relatively level so as to readily support any objects placed upon them. Further, top platform 53 is substantially contiguous with the ledges 51, 52 and forms an extended flat surface. Additionally, the chamber (not shown) formed beneath ledges 51, 52 may be utilized as additional storage by constructing book shelves and/or cabinets beneath any of those ledges 51, 52 Alternatively, chairs may be placed and utilized beneath the "table" created by the ledges 51, 52.

As shown in FIG. 2, back cushion member 60 comprises three bubble cushions 61, 62, 63, fixably mounted on frames 64, 65, said frames containing a plurality of slidable support bars 66. Frames 64, 65 preferably comprise a honeycomb material which renders them both light weight for easy handling and strong to support any pressure exerted by a person utilizing the unit. Frames 64, 65 are movably attached to each other via hinge 67. Frame 65 is fixably attached to flexible tab 68, which tab 68 extends the length of frame 65 allowing said tab 68 to be manipulated at any point and prevents small items from falling from the top platform 53. Tab 68 is useful for adjusting back cushion member 60 in order to allow conversion from the sitting position 20 to the sleeping position 90. Frame 65 is movably attached via hinge 69 to top platform 53. When the furniture is closed in sitting position 20, back cushion member 60 encloses a storage compartment 76 useful for storing articles, e.g., sheeting, pillows, blankets, etc., used to make up the bed when the furniture is opened in the sleeping position 90. The bubble cushion 61 is padded to prevent any injury or discomfort to the head of a person seated upon the sofa 20, while bubble cushions 62, 63 are also padded for comfort. The bubble pad 61 may be optionally removed from frame 65 in order to extend the surface formed by top platform 53 when in the closed position 20. While seams of the bubble pads 61, 62, 63 are illustrated as horizontal, seams may of course run vertically upon frames 64, 65; the appearance of the furniture padding should carry out the design of the furniture.

Figure 3:
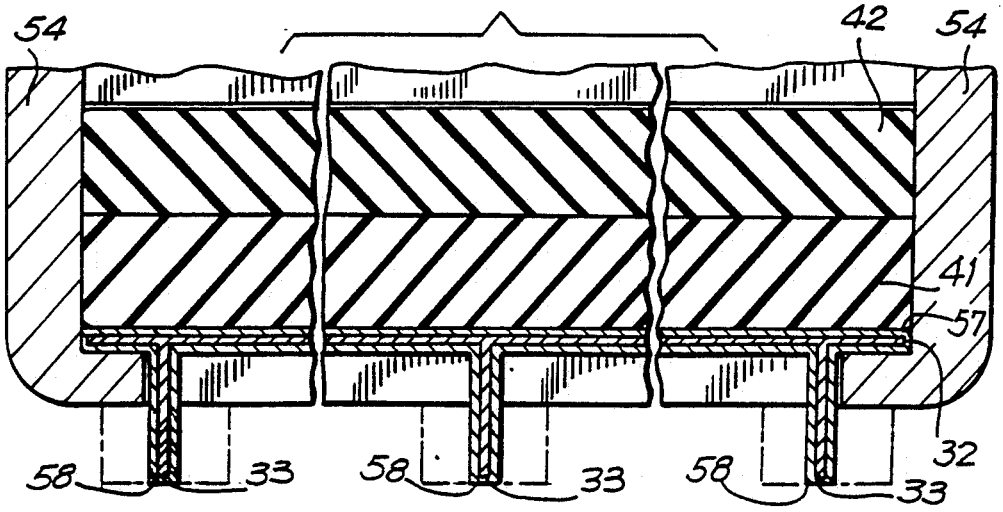
FIG. 3 is a view taken along lines 3—3 of FIG. 2 showing a front cross section of the lower portion of the article.

FIG. 3 illustrates bottom member 30 and double mattress 40 when inserted into housing member 50 in the closed sitting position 20. Legs 33 are inserted within and rest upon sleeve 57 of top housing 50. Thin plates 58, preferably comprising metal, form the bottom side of sleeve 57 adjacent to and resting upon the floor (not shown). Plate 58 facilitates sliding of bottom member 50 and is useful for protecting the floor when converting from the seat 20 to the bed 90. The bottom (not shown) of legs 33 can be made slidable through the use of, e.g., nylon glides, bearings, or a belt drive. A stopping means (not shown) prevents bottom member 30 from completely disengaging from sleeve 57. Plate 58 should be thin enough to prevent any substantial height differential of bottom member 30 from the floor when in either the open 90 or closed 20 position. Sleeve 57 is useful for aligning legs 33 as well as supporting portions of the unit, as well as objects or people resting on the unit. This feature of the present invention eliminates the bending of hinges and springs, thereby eliminating the possibility of damage to sheeting, etc. as well as decreasing the weight of the furniture which makes it easier to move and to convert. The length of a king-size sofa of the present invention is shorter than a conventional sofabed.

Figure 4:
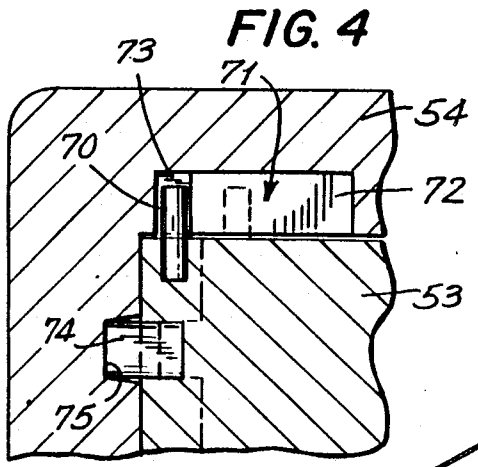
FIG. 4 is a view taken along lines 4—4 of FIG. 2 showing the mechanisms of the top platform which are slidably securable.

FIG. 4 illustrates a portion of top platform 53. When in the sitting position 20, platform 53 is partially supported in a horizontal position via two pins 70. Each groove 71 in side walls 54 consists of a horizontal groove 72 joined to form a continuous channel with vertical groove 73. Pins 70 comprise a means of securing and for movably converting the top of the apparatus from seat 20 to bed 90, while maintaining top platform 53 mounted within top housing 50. A plurality of rigid tabs 74 are fixably mounted to the leading edge of platform 53. When in the sitting position 20, tabs 74 are insertably engaged within corresponding slots 75, such slots 75 located in horizontal back ledge 52. Tabs 74 serve as a means to support, align, and maintain top platform 53 when in the sitting position 20, where the number of tabs 74 will be determined based upon the length back ledge 52.

Figure 5:
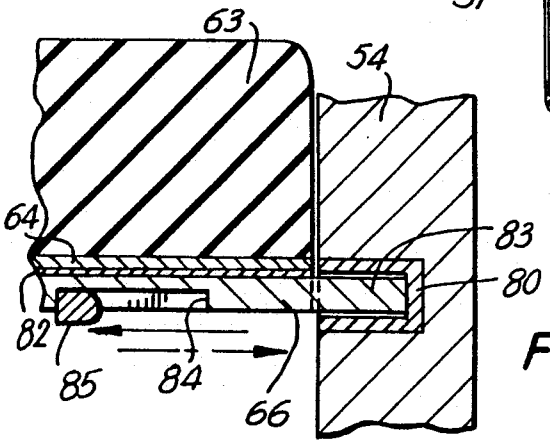
FIG. 5 is a view taken along lines 5—5 of FIG. 2 showing a slidable support bar.

FIG. 5 illustrates a slidable insertable support bar 66 contained within frame 64, which support bar 66 is insertably engaged within bar grooves 80 of side walls 54 when in the sitting position 20. Similarly, a support bar 66 mounted within frame 65 is insertable into bar grooves 81, and a bar support 66 mounted within top platform 53 is insertable into bar grooves 86. In the sitting position 20, support bars 66 support, align, and maintain back cushion member 60 and top platform 53 which enclose storage compartment 76. Support bar 66 comprises a bar casing 82 within which are two slidably coupled rods 83. Each rod 83 is inserted within bar grooves 80, 81, 86 located in each side wall 54 when in sitting position 20. Rods 83 contain a plurality of indentations 84 usable, via human fingers 85, for manually slidably positioning rod 83 within bar groove 80, 81 and 86. To convert from sitting position 20 to sleeping position 90, first rods 83 in frame 64 are withdrawn from bar grooves 80. This frees frame 64 to swing inward, allowing access to support bars 66 on frame 65 and top platform 53.

Figure 6:
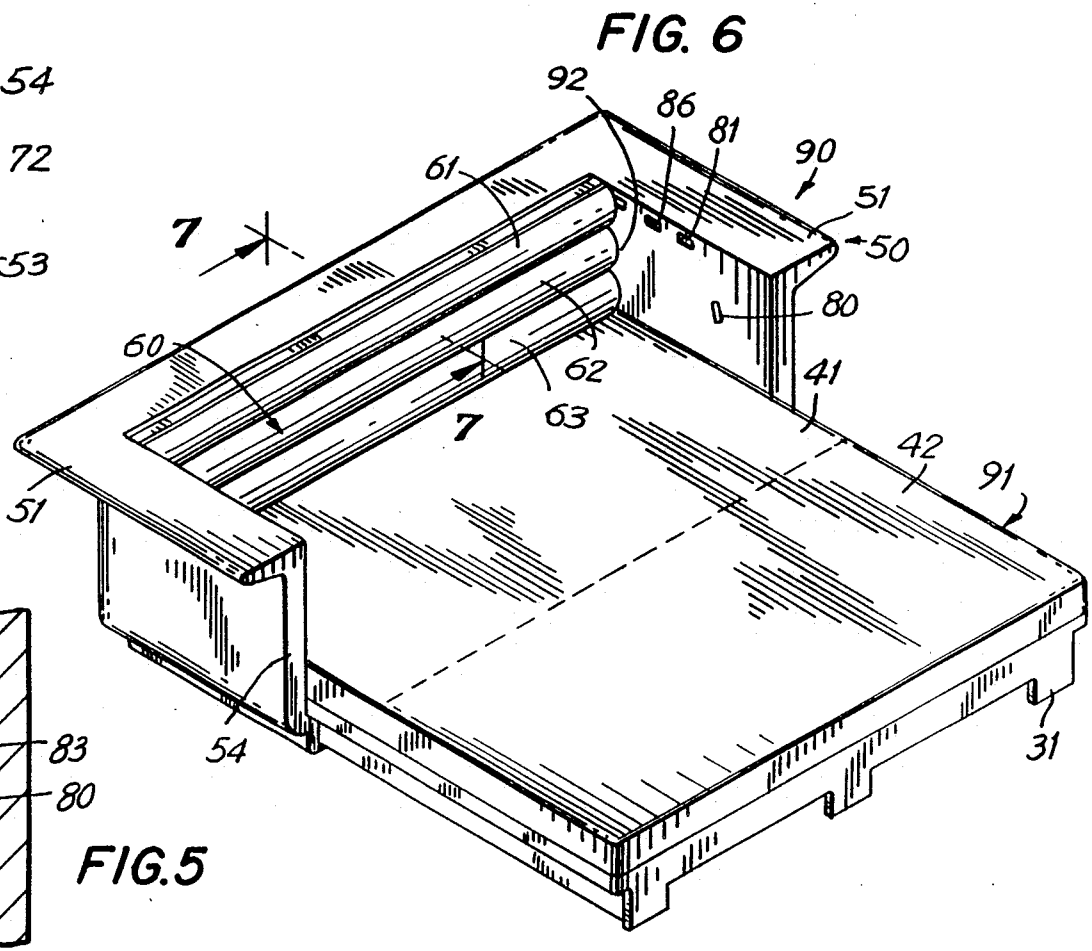
FIG. 6 is a perspective view of the article open in a sleeping position.

FIG. 6 illustrates the convertible article of furniture in the open sleeping position 90 wherein bottom member 30 has been retracted from within top housing 50, wherein double mattress 40 has been unfolded to allow lower mattress 41 and upper mattress 42 to lie adjacent forming a sleeping surface 91, wherein top platform 53 has been inserted within chamber 95, and wherein bubble cushions 61, 62 and 63 are vertically aligned to form head rest 92.

Figure 7:
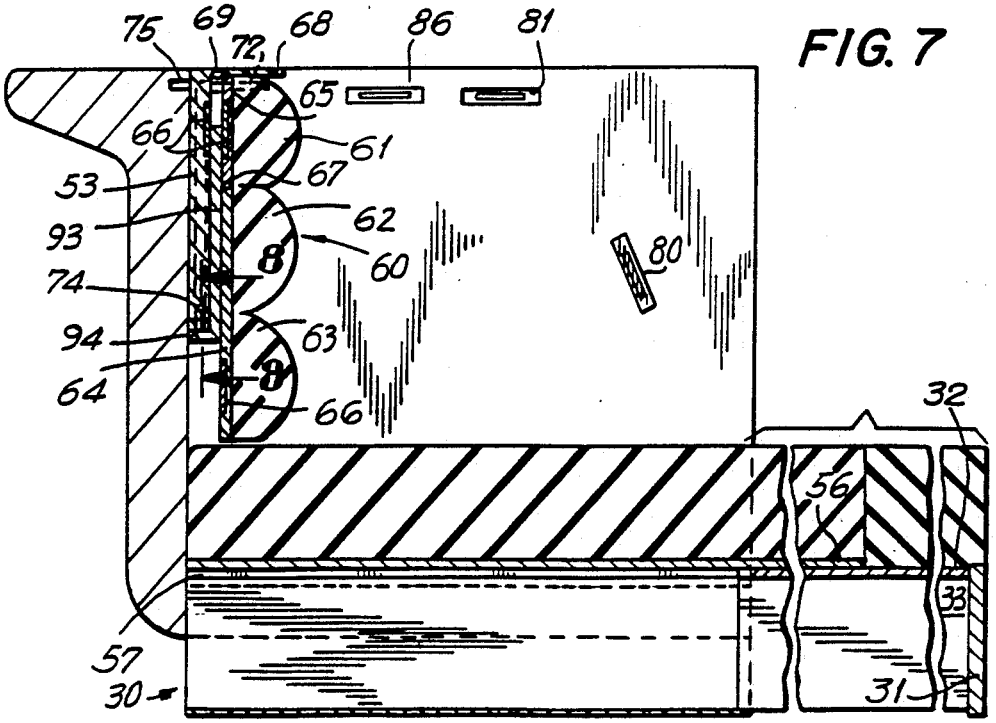
FIG. 7 is a view taken along lines 7—7 of FIG. 6 showing a side cross section of the article in the open sleeping position.

FIG. 7 illustrates the back cushion member 60 converted to head rest 92 when the unit is in the open position 90. Frames 64, 65 are aligned in a vertical position parallel to beam member 93. In order to convert from the sitting position 20 of FIG. 2 to the sleeping position 90 of FIG. 7, tab 68 is utilized in a lifting manner to withdraw tabs 74 from slots 75 and to position top platform 53 (with tabs 74 leading) in a downward direction. Utilizing tab 68, top platform 53 is inserted within chamber 95, formed by wall member 93 and back wall 55, with pins 70 proceeding from horizontal grooves 72 to vertical grooves 73, said platform 53 stopping on bottom beam member 94 of wall 93. The lifting of tab 68 simultaneously allows frames 64, 65 to align vertically against beam member 93 and exterior to chamber 95.

Figure 8:
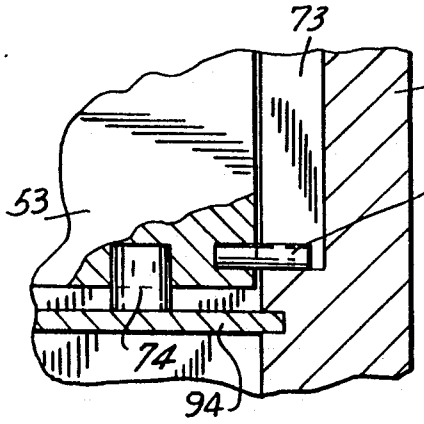
FIG. 8 is a view taken along lines 8—8 of FIG. 7 showing securing mechanisms of the top platform.

FIG. 8 illustrates a portion of top platform 53 as aligned when the unit is in sleeping position 90. Pins 70, fixably mounted on each side of the platform 53, protrude therefrom and into the two vertical grooves 73 located within side walls 54, thereby securing platform 53 within the unit. Tabs 74 rest upon bottom beam member 94.

Figure 9:
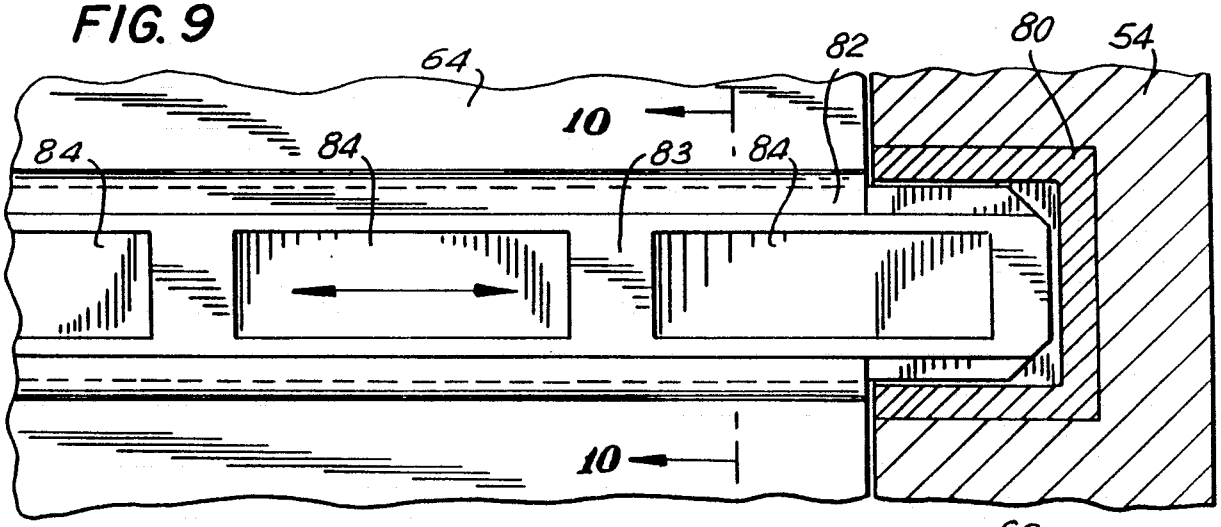
FIG. 9 is a front view of a slidable insertable support bar.

FIG. 9 illustrates a portion of the unit in sitting position 20 detailing the slidable support bar 66 from a front view where bar casing 82 is contained within frame 64 and where rod 83 is slidably inserted within bar groove 80 located within side wall 54. In sitting position 20, rod 83 is inserted and withdrawn from bar groove 80 by manual manipulation via indentations 84. Similarly, rods 83 are appropriately inserted within bar grooves 81 and 86.

Figure 10:
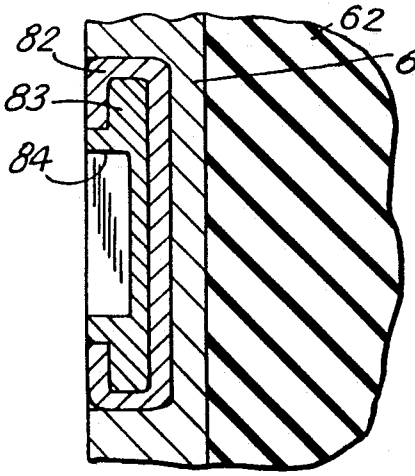
FIG. 10 is a view taken along lines 10—10 of FIG. 9 showing a cross section of the support bar.

FIG. 10 illustrates the support bar 66 in cross section as contained within frame 64. Bar casing 82 encloses rod 83, wherein indentation 84 is located on said rod 83.

Figure 11:
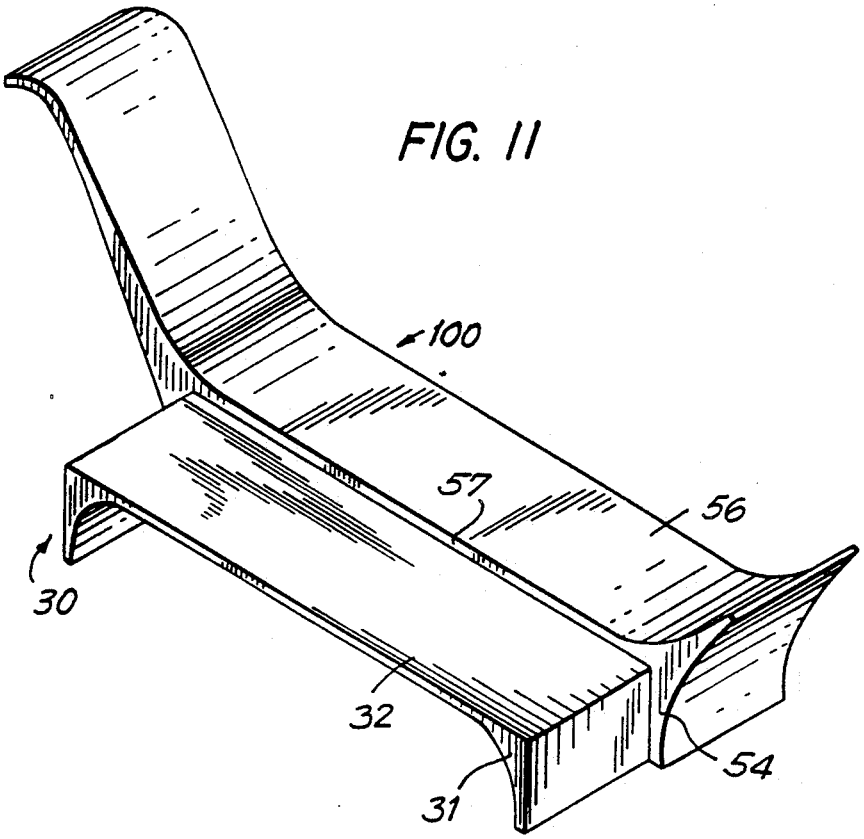
FIG. 11 is a perspective view of a sleep bench open in the sleeping position.

Retractable bottom member 30 can be utilized in furniture convertible from sitting unit 20 in addition to sofas. For example, sleep bench 100, as shown in Figure Il, can be convertible between the sleep bench and a twin bed wherein a bottom member 30 retracts from sleeve 57. A double mattress 40 (not shown in FIG. 11) will rest upon second bedspring 56 when in sitting position 20, and will unfold to rest upon both first bedspring 32 and second bedspring 56 when in sleeping position 90. As shown, facing 31 may cover two legs 33.

Figure 12:
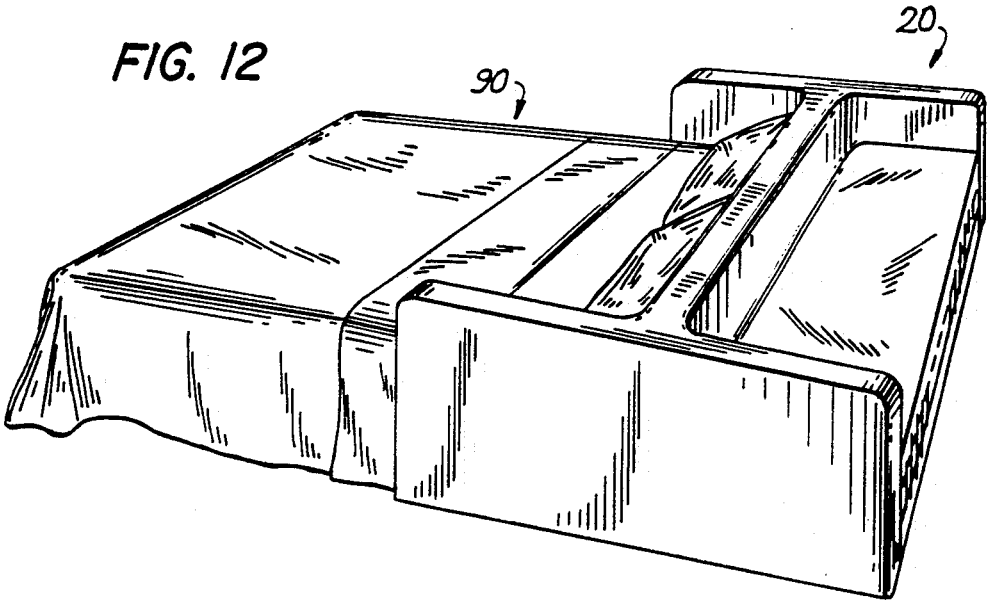
FIG. 12 ia a perspective view of a double sofa/single bed open in the sleeping position.

FIG. 12 illustrates a double sofa/single bed configuration where the article of furniture in the closed position 20 will feature two sofas (not shown), while the article in the open position 90 will feature both a bed 90 and a sofa 20. The retractable bottom member 30 can therefore be useful in many configurations.

While particular embodiments of the invention have been described, it will be understood, of course, that the invention is not limited thereto since many obvious modifications can be made, and it is intended to include within this invention any such modifications as will fall within the scope of the invention as defined by the appended claims.

I claim:

1. An article of furniture including two sides and a back, which is convertible between a sitting unit when closed and a sleeping unit when open, comprising:

a top housing wherein both of the sides and the back flare out horizontally at the top, creating a ledge;

a storage compartment formed within the housing when in the closed position;

a padded back cushion member forming a first side of the storage compartment when in the closed position and forming a vertical head rest when in the open position;

a top platform contiguous to the flared sides and back which extends the flat surface of the ledge thereby formed, which platform forms a second side of the storage compartment when in the closed position;

a wall member within the housing forming a chamber for storage of the top platform when in the open position;

a double mattress forming a sitting surface in the closed position, which mattress unfolds to form a sleeping surface in the open position; and a bottom member, inserted within a sleeve of the top housing when in the closed position, which member slidably protrudes to support in part the mattress in the open position.

2. The article of furniture of claim 1 wherein the length of the sitting unit is of a standard love seat in size in the closed position and a three-quarter bed in the open position.

3. The article of furniture of claim 1 wherein the length of the sitting unit is of a chair in the closed position and of a twin bed in the open position.

4. The article of furniture of claim 1 wherein the length of the sitting unit is of a sofa in the closed position and of a bed in the open position.

5. The article of furniture of claim 4 wherein the bed is selected from the group consisting of a full-size, a queen-size, and a king-size bed.

6. The article of furniture of claim 4 wherein the bottom member comprises a bedspring, three legs, and a facing.

7. The article of furniture claim 6 wherein the bedspring is beechwood slats.

8. The article of furniture claim 6 wherein the bedspring is steel bands.

9. The article of furniture of claim 1 wherein a storage chamber is constructed beneath and is formed in part by the flared back of the furniture.

10. The article of furniture of claim 9 wherein the storage chamber is a bookcase.

11. The double mattress of claim 1 comprising a two-layer sitting cushion of the furniture in the closed position, which two layers are connected at one edge, and which cushion unfolds to form a single-layer sleeping surface of the furniture in the open position.

wherein the top layer of the cushion is somewhat thicker than the bottom layer such that, when the cushion is unfolded to form the sleeping surface, the sleeping surface formed is flat for comfort in sleeping.

12. The article of furniture of claim 1 wherein the portions of the storage compartment forming the top platform and the back cushion member is supported by a plurality of bars with rods contained within and slidably extending from those portions into the sides of the furniture, where said rods are manually securable within bar grooves by manipulation of the rods via a plurality of indentations in said rods.

13. The article of furniture of claim 1 wherein the back cushion member comprises padded cushions upon frames wherein the frames are a honeycomb material.

14. The article of furniture of claim 1 wherein a flexible tab is located along the length of the back cushion member allowing the top platform to be lifted and inserted into the chamber during conversion to the open position.

15. The article of furniture of claim 14 wherein the top platform is partially supported and aligned by two pins which insertably engage grooves within the sides of the furniture, which grooves guide the platform from a horizontal orientation in the closed position to a vertical orientation and located within the wall member in the open position; and wherein a plurality of rigid tabs on a leading edge of the top platform insertably engage corresponding slots in the back ledge to support, align, and maintain said platform in the closed position.

* * * * *